United States Patent [19]

Robb

[11] 4,173,099

[45] Nov. 6, 1979

[54] PET DOORS

[75] Inventor: Donald Robb, Penwortham, England

[73] Assignee: Reilor Limited, Lancaster, England

[21] Appl. No.: 927,722

[22] Filed: Jul. 24, 1978

[51] Int. Cl.[2] ..... E06B 7/28

[52] U.S. Cl. ..... 49/168; 49/383; 49/388; 49/394

[58] Field of Search ..... 49/168, 163, 169, 170, 49/171, 192, 193, 394, 383, 388, 400, 401, 402; 160/DIG. 8, 354; 119/19

[56] References Cited

U.S. PATENT DOCUMENTS

| | | | |
|---|---|---|---|
| 3,138,829 | 6/1964 | Grose | 49/193 |
| 3,184,803 | 5/1965 | Peel | 49/388 |
| 3,384,996 | 5/1968 | Gilchrist et al. | 49/383 |
| 3,797,554 | 3/1974 | Johnson | 160/DIG. 8 |
| 3,978,616 | 9/1976 | Pennock | 49/394 X |

*Primary Examiner*—Philip C. Kannan
*Attorney, Agent, or Firm*—Norris & Bateman

[57] ABSTRACT

A moulded plastics pet door for relatively large animals comprising a rectangular frame for attachment to the sides of an aperture in a main door, a second U shaped frame engaging a frame on the rectangular frame and a flap engaging a frame on the second frame both the frame and the flap being pivoted on a rod extending transversely of the rectangular frame, shielded magnets being provided on the second frame and the flap to engage shielded keepers on the second frame and the flap. The flap is moulded with hollow reinforcing ribs and with slots in the rear side to receive bolts for locking the second frame and flap to the rectangular frame to prevent use of the pet door.

3 Claims, 5 Drawing Figures

PET DOORS

This invention relates to improvements in pet doors capable of being opened by the animal from both sides.

STATE OF THE ART

A pet door has been proposed comprising a rectangular frame moulded in plastics for attachment to a door opening, the vertical sides of the frame being provided with inwardly extending flanges, a second rectangular frame of substantially U shape with flanges on the outer edges of the second frame to engage the flanges on the first frame, pivot sockets on the end of each leg of the second frame engaging in recesses in the first frame and a making up and anchoring member to locate and retain the pivot sockets of the second frame in the recesses of the first frame, a door flap pivoted on the sockets on the legs of the second frame on the side of the first frame remote from the second frame to allow the flap to pivot in one direction and the flap and the second frame to pivot together in the opposite direction.

Such a pet door is most satisfactory for cats or other relatively small animals but if enlarged for large dogs it can become a security hazard as burglars or other marauders can pass therethrough.

Furthermore if a metal door is employed in sub-zero temperatures the animals nose will stick to the frozen door and the object of the invention is a pet door with locking means to prevent unauthorized entry and in which any metal parts are shielded from contact with the animal.

THE PRESENT APPLICATION

According to the invention the door comprises a rectangular frame of channel shape extruded from a plastics material for attachment to a door opening, the inner member of the channels on the sides and bottom of the frame being provided with inwardly extending flanges, a second rectangular channel frame of substantially U shape extruded from a plastics material to engage the flanges on the rectangular frame, reinforcing moulded channel corner members welded inside the channels of the rectangular frame with holes in the upper reinforcing members to provide sockets for the ends of a rod on which the second frame is pivoted, a door flap pivoted on the rod inwardly of the second frame to open in the opposite direction from the second frame, a magnet mounted on the outer side of the flange on the bottom of the flap to engage a metal keeper forming one side of the bottom channel member of the second frame, a second magnet being mounted on the bottom channel member of the second frame parallel to the metal keeper thereon for engagement by a keeper on the outer bottom flange of the rectangular frame and bolts mounted to slide in the flap to engage the rectangular frame and the second frame to prevent the door from opening.

The dog door is formed with a rectangular frame moulded in a plastics material for attachment to the sides of an opening for a normal door. The vertical sides of the frames are provided with inwardly extending flanges extending from the lower inner edges of the frame to adjacent the upper ends of the sides.

A second rectangular frame of substantially U shape and a door flap are pivoted on a rod extending into bearings in the first rectangular frame. The rod passes through a flange in the first frame, the hole being subsequently plugged.

The flanges on the outer edges of the second frame engage the flanges on the sides and lower edge of the first frame and are capable of pivotal movement away from the first frame in one direction.

A door flap pivoted on the rod is allowed to pivot through substantially 180° when assembled on the opposite side of the first frame. The door flap is hung to be capable of pivoting in the opposite direction to that of the second frame. Each side edge of the door flap is provided with a flange to engage the flange of the second frame to limit the movement of the door flap in one direction.

To give access through the door from the inside of the building pressure on the door flap causes the door flap to pivot on the second frame which is prevented from movement by a rim along its lower edge engaging a rebate in the first frame.

To give access through the door in the opposite direction i.e. from inside the building pressure on the door flap causes the door and the second frame to pivot on the first frame to allow for passage through the door opening.

The invention will be described with reference to the accompanying drawings.

Figure 1:
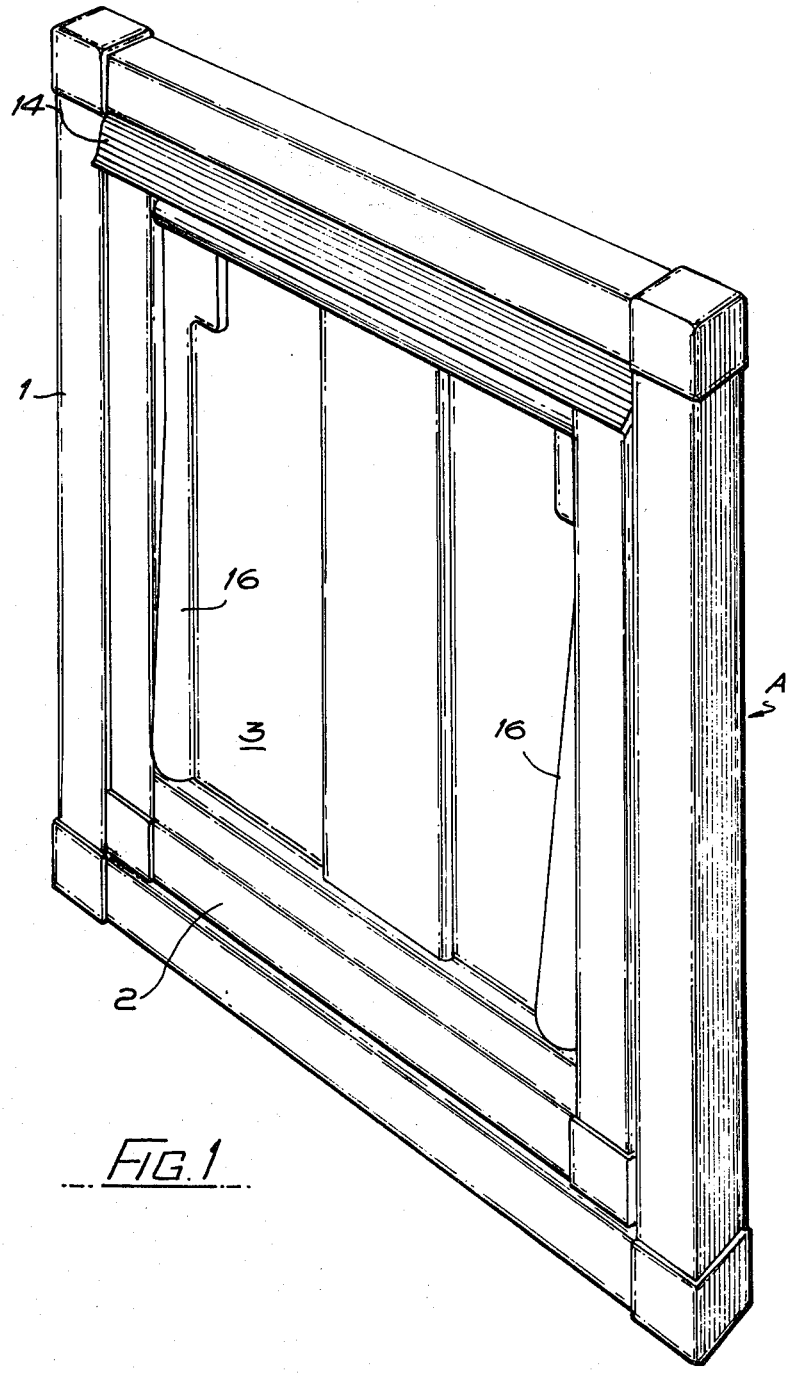
FIG. 1 is a perspective view of a door from the front.
Figure 2:
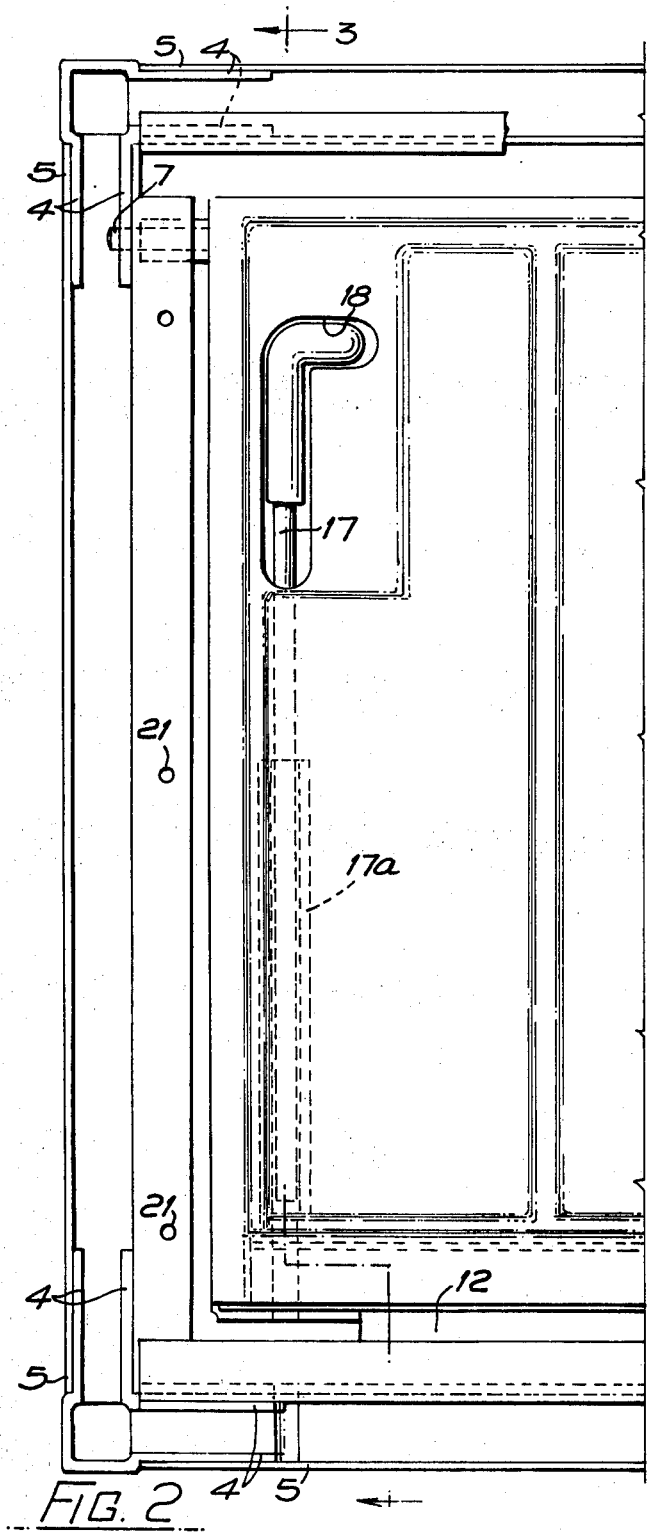
FIG. 2 is an elevation of one half of the door from the rear side.
Figure 3:
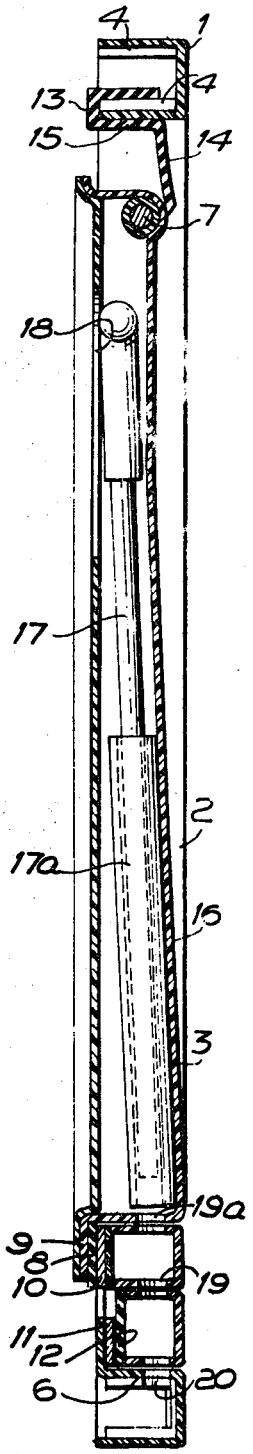
FIG. 3 is a vertical section on line 3—3 FIG. 2.
Figure 4:
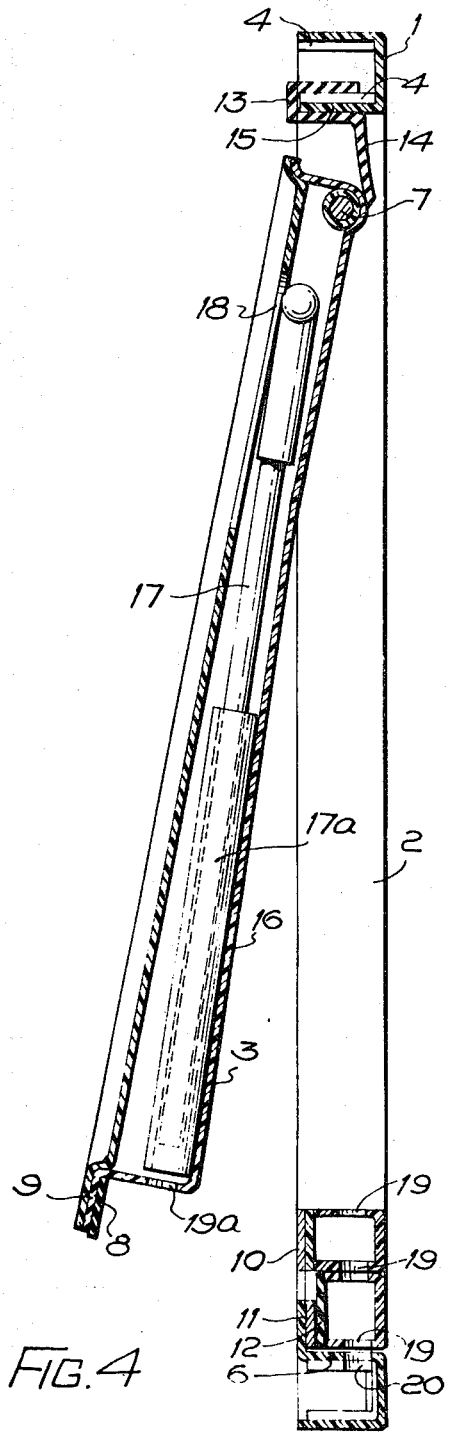
FIG. 4 is a similar section showing the front door partly open.
Figure 5:
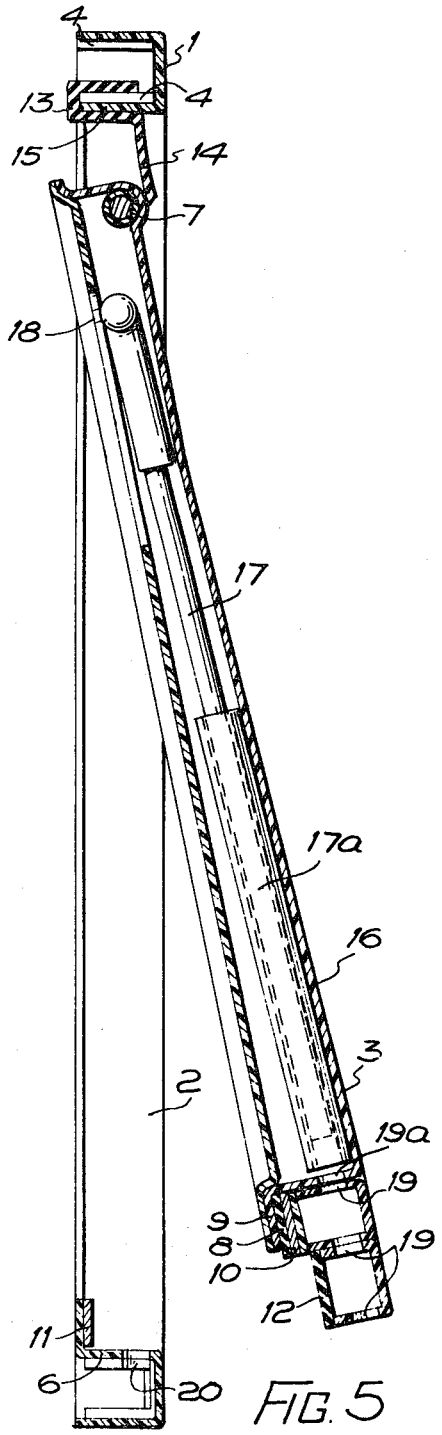
FIG. 5 is a similar section showing the rear door partly open.

A dog door A is formed with a rectangular frame 1 a second U shaped frame 2 and a flap 3.

The rectangular frame 1 is extruded from a plastics material of channel shape reinforced at the corners with moulded channel shaped L members 4 recessed to accommodate the outer members 5 of the frame which are welded thereto. The channel members are formed with inwardly extending flanges 6.

The second U shaped frame 2 also of channel shape is extruded from a plastics material to engage the flanges 6 on the rectangular frame 1. The legs of the second frame 2 are pivoted to the reinforcing members 4 on the upper side of the rectangular frame 1 on a rod 7 passing through holes in the reinforcing member and through holes in the legs.

The flap 3 is pivoted on the rod inwardly of the second frame 2 to open in the opposite direction from the second frame.

The magnet 8 is mounted on the outer side of a flange 9 on the bottom of the flap 3 to engage a metal keeper 10 forming one side of a plastics box member of the second frame 2 to mask the keeper 10 from contact with the animal.

A second magnet 11 is mounted on the bottom channel member of the second frame 2 parallel to the metal keeper 10 thereon for engagement by a keeper 12 on the outer bottom flange of the rectangular frame 1, the magnet 11 again being masked from contact with the animal.

A flexible strip 13 of rubber or a plastics material of channel shape with a flange 14 along one edge is applied over the inner flange 15 of the upper channel member of the rectangular frame 1 with the rubber or plastics flange overlaying the outer side or front of the legs of the second frame and the flap to act as a weather and wind guard for the door.

The flap 3 is extruded from a plastics material with raised panels and ribs 16 for reinforcement. At each side the flap is formed with a bore to receive bolts 17 with L shaped upper ends sliding in slots 18 in the back of the flap. The bolts 17 pass through guides 17*a*. The bolts 17 when extended pass through holes 19*a* in the flap 3 and through holes 19 in the bottom of the second frame and holes 20 in the rectangular frame to prevent the opening of the door from either side. The upper ends of the side ribs are flattened to apply friction to the bolts when in the raised position to prevent rattle then the door is free for operation. The slots 18 for the bolts 17 may be L shaped to accommodate the upper ends of the bolts 17 when in the inoperative position.

The door A for large dogs are of a size to allow the passage of persons and accordingly the means must be provided for preventing entrance as required.

The frame 1 is secured to the door opening by screws passage through holes 21 in the inwardly extending flange of the rectangular flange.

What I claim is:

1. A pet door mounting in an opening in an existing door, of the kind capable of being opened from both sides comprising a rectangular frame of channel shape extruding from a plastics material for attachment to a door opening, the inner member of the channels on the sides and bottom of the frame being provided with inwardly extending flanges, a second rectangular channel frame of substantially U shape extruded from a plastics material to engage the flanges on the rectangular frame, reinforcing moulded channel corner members welded inside the channels of the rectangular frame with holes in the upper reinforcing members to provide sockets for the ends of a rod on which the second frame is pivoted, a door flap pivoted on the rod inwardly of the second frame to open in the opposite direction from the second frame, a magnet mounted on the outer side of the flange on the bottom of the flap to engage a metal keeper forming one side of a box member welded to the inner side of the bottom channel member of the second frame, a second magnet being mounted on the bottom channel member of the second frame parallel to the metal keeper thereon for engagement by a keeper on the outer bottom flange of the rectangular frame and bolts mounted to slide in the flap to engage the rectangular frame and the second frame to prevent the door from opening.

2. A pet door as in claim 1 in which the flap is reinforced by hollow ribs to receive the belts which slide in slots in the ribs to pass through holes in the second frame and the rectangular frame to render the door inoperative.

3. A pet door as in claims 1 or 2 in which a weather guard extends over the pivot rod for the second frame and the flap.

* * * * *